United States Patent [19]

Bader

[11] 4,088,215

[45] May 9, 1978

[54] RECORD MEDIA COMPENSATION MEANS FOR PRINTERS

[75] Inventor: Leonhard Bader, Stadtbergen, Germany

[73] Assignee: NCR Corporation, Dayton, Ohio

[21] Appl. No.: 749,590

[22] Filed: Dec. 10, 1976

[51] Int. Cl.[2] ..... B41J 7/92

[52] U.S. Cl. ..... 400/56; 346/139 C; 360/75; 73/DIG. 3; 400/59; 400/124

[58] Field of Search ..... 197/1 R, 149, 144; 346/139 C, 140 R; 101/93.33, 93.34; 360/75; 73/DIG. 3

[56] References Cited

U.S. PATENT DOCUMENTS

| | | | |
|---|---|---|---|
| B 481,600 | 1/1976 | Thomas et al. | 101/93.14 |
| 2,141,975 | 12/1938 | Finch | 346/139 A |
| 2,993,437 | 7/1961 | Demer et al. | 101/93.14 |
| 3,048,665 | 8/1962 | Wilcox | 360/75 |
| 3,049,990 | 8/1962 | Brown et al. | 101/93.34 |
| 3,146,058 | 8/1964 | Henshaw | 346/139 C |
| 3,164,013 | 1/1965 | Schmahl et al. | 73/DIG. 3 |
| 3,183,830 | 5/1965 | Fisher et al. | 101/93.03 |
| 3,614,579 | 10/1971 | Fulton | 346/139 C |
| 3,632,900 | 1/1972 | Knizweil et al. | 360/75 |
| 3,705,408 | 12/1972 | Krone et al. | 346/139 C |
| 3,706,861 | 12/1972 | Giel | 360/75 |
| 3,750,792 | 8/1973 | Liles | 197/1 R |
| 3,817,365 | 6/1974 | Zimmerman | 197/1 R |
| 3,837,461 | 9/1974 | Waibel | 101/287 |
| 3,981,235 | 9/1976 | Thomas et al. | 101/93.14 |

FOREIGN PATENT DOCUMENTS

| | | | |
|---|---|---|---|
| 2,267,885 | 11/1975 | France | 197/1 R |
| 2,162,230 | 6/1973 | Germany | 197/1 R |
| 1,358,507 | 7/1974 | United Kingdom | 197/1 R |

OTHER PUBLICATIONS

Carpenter et al., *Forms Sensor For Automatic Platen*, IBM Technical Disclosure Bulletin vol. 13 No. 12 p. 3643 May 1971.

Aero Vox Research Worker vol. 36 No. 1-12 Jan.-Dec. 1966.

*Primary Examiner*—William Pieprz

*Attorney, Agent, or Firm*—J. T. Cavender; Albert L. Sessler, Jr.

[57] ABSTRACT

A printing device is provided which includes a feeler pivotally mounted on a printer frame and urged into engagement with record media positioned on a platen for printing. A magnetic element on the feeler coacts with a Hall generator on the frame to provide a control voltage which is effective to control a motor for positioning of the frame so that a print head mounted on said frame is located at a proper distance from the record media for printing thereon.

2 Claims, 5 Drawing Figures

RECORD MEDIA COMPENSATION MEANS FOR PRINTERS

BACKGROUND OF THE INVENTION

In the field of high-speed printing devices which are especially suitable for use in connection with electronic data processing systems, the wire matrix type of printer has come into increasing use. In this type of printer, letters, numbers and symbols are formed from a series of dots produced by the impact of the ends of a plurality of wire elements on record media.

Since the wires employed in the matrix printer have a short operating stroke, it is important that a uniform distance be maintained between the print head and the upper surface of the medium being printed upon. It is therefore important, in those cases in which a plurality of different thicknesses of record media may be printed upon by a matrix printer, to provide a compensating device which acts to maintain the same relative distance between the print head and the upper surface of the record media regardless of changes in the thickness of the record media.

Various compensation devices for maintaining a predetermined distance between the print head and the record media regardless of the thickness of the record media are known in the prior art. In some of these, print head guide rollers are run along a flexible tape secured at its ends. In another arrangement, an axially reciprocable probe is used to determine the position of the surface of the record media to be printed upon, and controls a motor which positions the print head accordingly.

SUMMARY OF THE INVENTION

This invention relates to an arrangement in a printing device for controlling the distance between record media and the printing elements of a print head by use of sensing means which acts through a transducer to control motor means operable to change the position of the print head.

According to one embodiment of the invention, a printing device for printing on record media which may be of different and varying thicknesses, said record media being introduced to the printing device in a given direction, comprises a carriage; a carrier operatively connected to the carriage; a frame mounted on said carrier; a printer mounted on said frame, said printer and said carriage being capable of relative movement therebetween in a direction transverse to the direction of introduction of the record media to the printing device; positioning means operatively connected to the frame and the carrier and including a motor capable of continuously positively positioning the frame with respect to the carrier in either of two directions so that the printer is located a predetermined distance from the record media for proper printing thereon; circuit means including a Hall effect transducer fixed to the frame, a comparator for comparing a reference voltage with the voltage generated by the Hall effect transducer and switching means controlled by the comparator for controlling said positioning means; and sensing means pivotally mounted between its ends on said frame and including a feeler at one end, said sensing means being biased to engage the record media and to be continuously responsive to variations in the thickness thereof, said sensing means also including magnetic means at its other end for coacting with the Hall effect transducer for causing said circuit means continuously to control the positioning means to alter the position of the printer in accordance with movement of the sensing means to maintain continuously said printer a predetermined distance from the record media regardless of variations in the thickness of said media.

It is accordingly an object of the present invention to provide a printing device having a novel compensating means for maintaining a given distance between a printing head and the record media to be printed upon, regardless of the thickness of said media.

Another object is to provide a printing device in which sensing means acts through a transducer to control motor means operable to change the position of a print head to maintain a predetermined distance between said print head and the record media being printed upon.

A further object of the invention is to provide a printing device in which sensing means acts through a Hall generator to control motor means operable to change the position of a print head to maintain a predetermined distance between said print head and the record media being printed upon.

With these and other objects, which will become apparent from the following description, in view, the invention includes certain novel features of construction and combinations of parts, a plurality of embodiments of which are hereinafter described with reference to the drawings which accompany and form a part of this specification.

DESCRIPTION OF THE PREFERRED EMBODIMENTS

Figure 1:
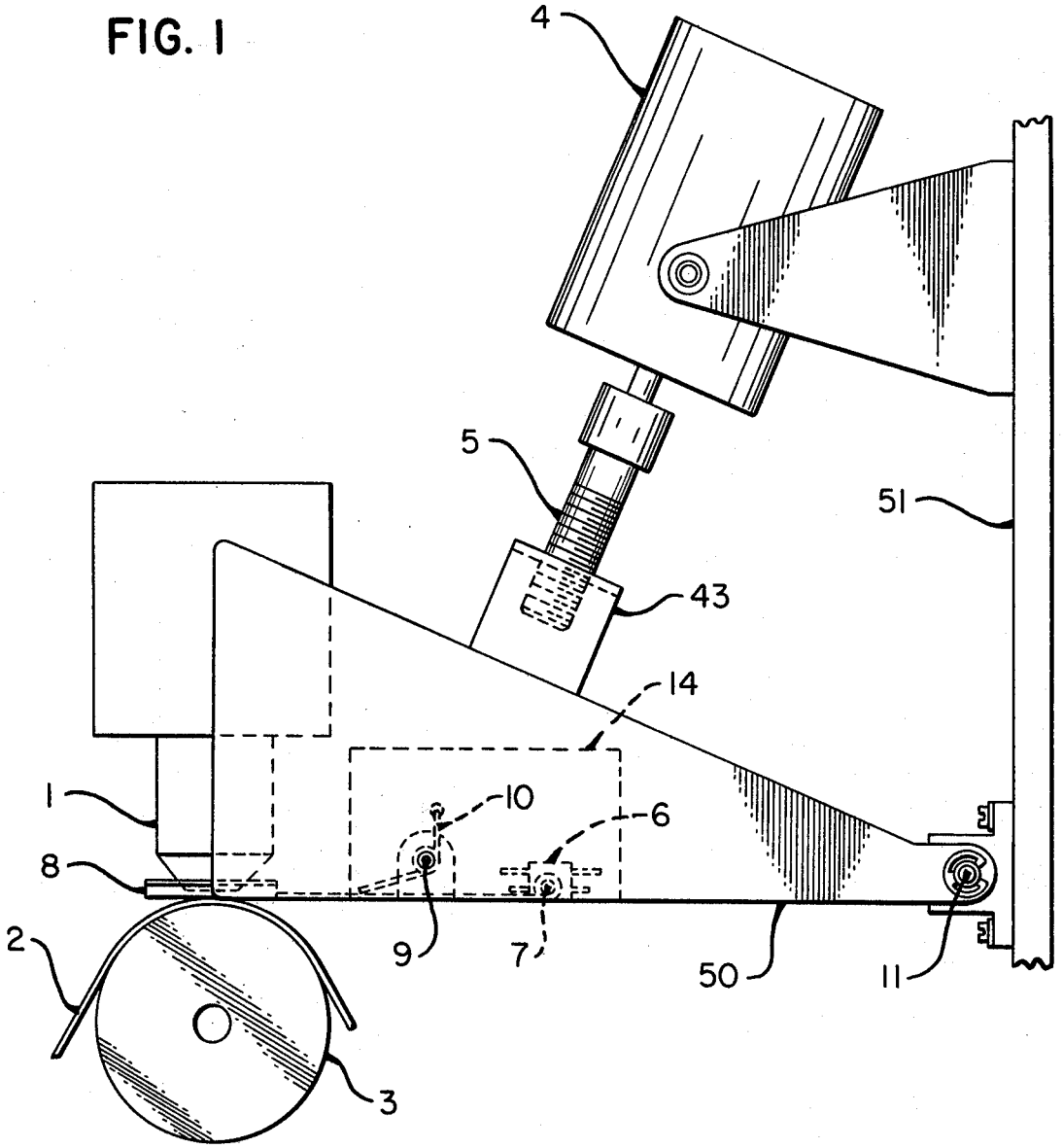
FIG. 1 is an elevation view of the printing device of the present invention.

Referring now to FIG. 1, the transport of one record medium or several record media is accomplished by suitable means, such as a platen 3. The thickness of the record medium 2 is sensed by a printing head distance feeler 8 so that, as will hereinafter be described in detail, independent of the thickness of the record medium 2, constant distance is maintained between the printing elements 13 (FIGS. 2 and 5) of a printing head 1 and the record medium 2. The printing head distance feeler 8 is pivotally supported by a shaft 9, so that upon a rocking movement of the left-hand part of the printing head distance feeler 8 upwardly (FIG. 1) the right-hand part thereof performs a rocking movement downwardly. By means of a spring 10 the upper part of the printing head distance feeler is caused to constantly rest upon the record medium 2 being passed over the platen 3, and this at a low bearing force of, for instance, 20 dynes.

The right end (FIG. 1) of the printing head distance feeler 8 has secured thereto a magnet 7 which acts upon a Hall generator 6. Said Hall generator 6 is fastened to a suitable support 14 on a pivotally mounted frame 50 which has arranged thereon the printing head 1. The frame 50 and the printing head 1 thereon are rockable around a centre of rotation 11 whenever suitable signals are being applied to the servomotor 4. The centre of rotation 11 and the servomotor 4 are provided on a carrier 51 which is movable transversely relative to the transport direction of the record medium 2. Caused by the rotation of the shaft of the servomotor 4, a bolt 5 having an external thread and being secured to the shaft moves into an element 43 having an opening with an internal thread and being connected through the frame 50 to the printing head 1. By rotation of the shaft of the servomotor 4, the bolt 5 thus is moved into or out of, respectively, the element 43, so that in dependence upon the direction of rotation of the servomotor, the printing head 1 is moved either away from or towards the record medium 2.

The servomotor 4 is controlled for adjusting the distance of the printing head 1 from the record medium 2 by means of the Hall generator 6.

Figure 2:
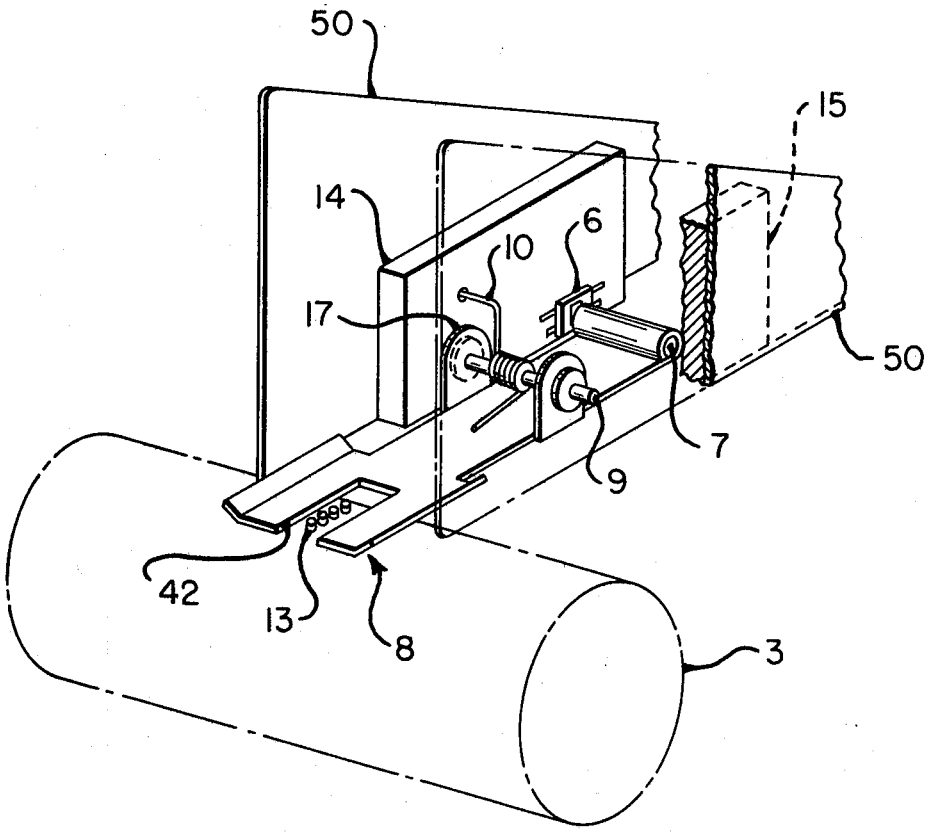
FIG. 2 is a partial perspective view of the printing device shown in FIG. 1.

FIG. 2 is an enlarged view of the printing head distance feeler 8. The distance feeler 8 has a recess 42 through which individual printing needles 13 of the printing head 1 can move to print on the record medium 2 which is guided over the platen 3 (FIG. 1). By means of the spring 10 acting upon the distance feeler 8 it is ensured that the latter rests with a light bearing force against the platen 3, or respectively, a record medium led thereover. In case of the thickness of the record medium changing, the distance feeler 8 is rocked around the axle or shaft 9 extending through two guide elements 17 and 18 (FIG. 2) on said feeler 8. Thereby the Hall generator 6, being fixed with respect to the printing head 1, is influenced in proportional relationship by the magnet 7 secured to the distance feeler 8. The parts 15 and 14 (FIG. 2) are, as already mentioned, fixed with respect to the printing head 1.

In the present arrangement, the Hall generator 6 will produce a voltage ranging, for instance, between 0.2 and 0.5V, which represents a dimension for the local position of the distance feeler 8 in relation to the record medium. The manner in which the voltage as produced by the Hall generator 6 is utilized in an automatic control system for the purpose of regulating the distance between the printing head 1 and a record medium 2 (FIG. 1) or 2*a* and 2*b* (FIG. 5), respectively, will now be described in connection with the block diagram of FIG. 3. In a comparison means 44, a standard magnitude W in the form of a nominal value voltage which is preadjusted by a potentiometer 19 (FIG. 4) is compared with an actual value voltage signal 52 as produced by the Hall generator 6. The result is a signal having a deviation of magnitude X which is supplied to a nominal value adjusting controller 12*b*, 12*c*, 12*d*, which latter produces a control signal having magnitude Y, acting upon the servomotor 4. A change is thereby produced, in the manner previously described, in the distance of the printing head 1 from the record media 2, which change, via the distance feeler 8, again influences the Hall generator 6, this causing the automatic control system according to FIG. 3 to be closed.

Figure 4:
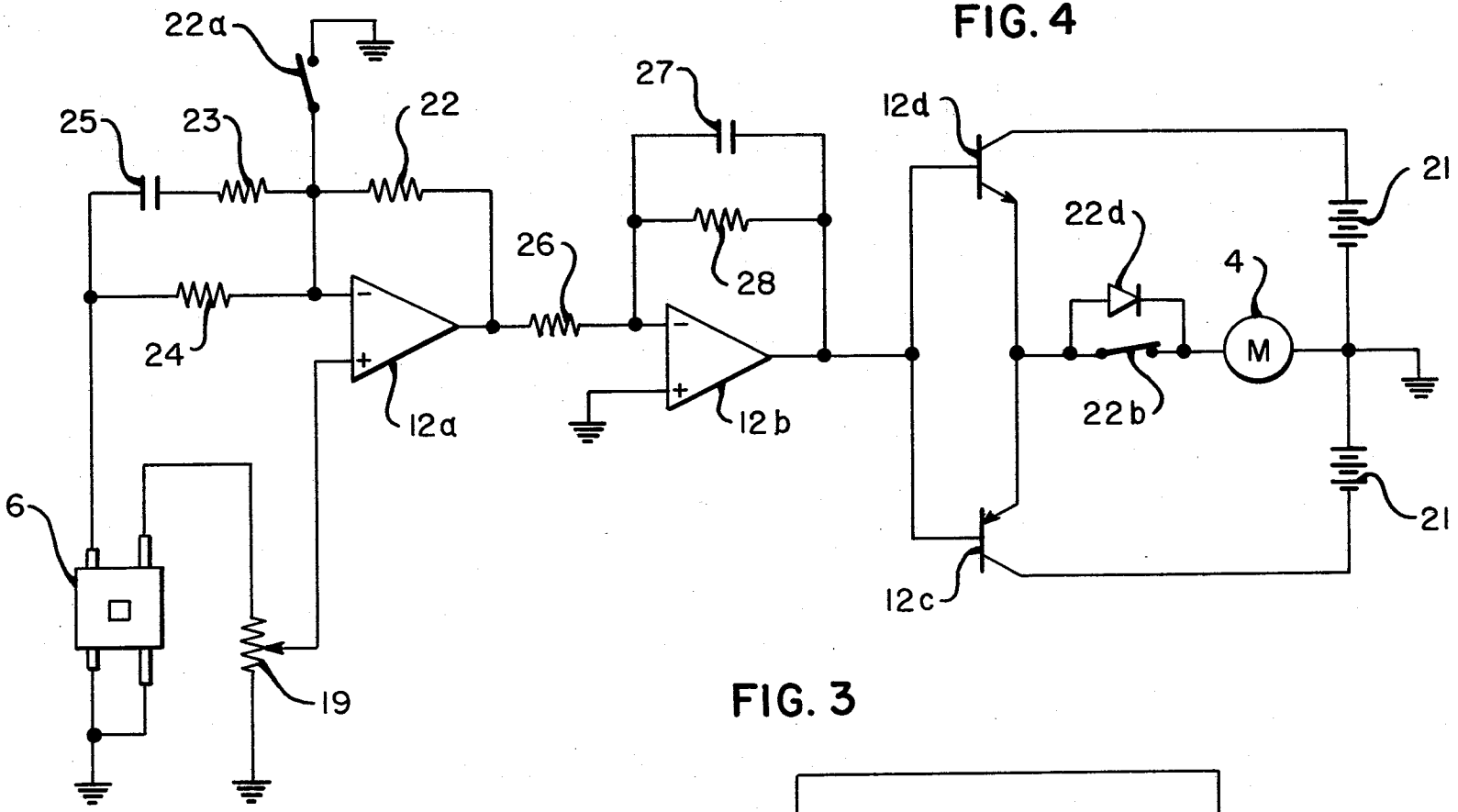
FIG. 4 is a circuit diagram of the control system of the present invention.
Figure 3:
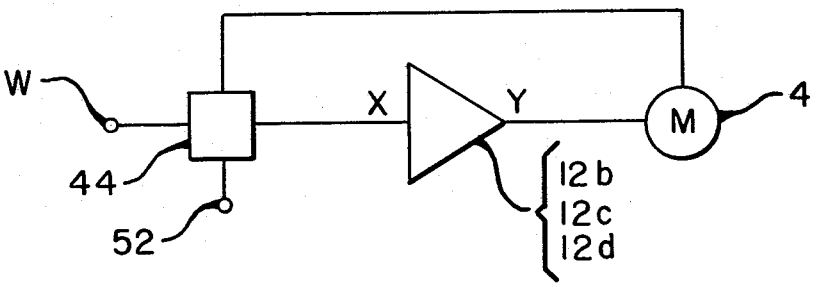
FIG. 3 is a block diagram of the control system of the present invention.

The electrical functioning of the automatic control system as shown in FIG. 3 in a simplified manner will now be explained with reference to FIG. 4.

Via a potentiometer 19, a controller 12*a*, formed as a proportional/differential controller (P/D-controller) has supplied thereto a nominal value voltage. The functioning or the characteristic, respectively, of said P/D-controller 12*a* is determined in a known manner by resistors 22, 23, 24 and a capacitor 25. The two lower terminals of the Hall generator 6 in FIG. 4 are connected to a base reference potential, shown as ground, while the two upper terminals, via said resistors 23, 24 and the capacitor 25, or via the potentiometer 19, respectively, are connected to the P/D-controller 12*a* comprising two inputs. If a switch 22*a*, which connects the negative input of the controller 12*a* to a base reference potential, shown as ground, is closed, a corresponding potential level is applied to the negative input of the controller 12*a*. The resulting output signal from the controller 12*a* is amplified by an amplifier 12*b*, and causes a transistor 12*c* to conduct, whereby the motor is, for instance, driven in a clockwise direction. The "right-hand" rotary direction in this case means a rocking-away of the printing head 1 from the record medium 2. Said rocking-away movement is stopped by a built-in throttle switch 22*b* after the printing head's removal from the record medium for a distance of approximately 6 millimeters. The throttle switch 22*b* then opens to interrupt the motor branch circuit. The rocking-away movement is of essential advantage since a record medium can then easily be inserted through the 6 mm wide gap. By the subsequent opening of the switch 22*a* the hitherto existing automatic control system becomes effective again. The relative potentials applied to the two inputs of the controller 12*a* now cause transistor 12*d* to be rendered conducting, thereby causing the motor 4 to be driven in a counter-clockwise direction. The diode 22*d* is provided to enable the motor branch circuit to be completed for driving of the motor 4 in one direction, counter-clockwise in the example given, despite the switch 22*b* being open. The driving of the motor in a counter-clockwise direction ceases when the desired distance is reached. As already mentioned, the Hall generator as used here produces a voltage ranging between 0.2 and 0.5V. In the embodiment as described, the magnitude of the voltage as produced by the Hall generator depends on the position of the distance feeler 8 and, thus, directly on the thickness of the record medium used.

The result as produced in the controller 12*a* is supplied via a resistor 26 to the amplifier 12*b* which is fed back via a capacitor 27 and a resistor 28. The amplifier 12*b* has a positive and a negative input. The positive input is connected to a base reference potential, shown as ground, while the previously mentioned signal, interpreting the deviation from standard, is applied to the negative input.

The output of the amplifier 12*b* is coupled over two transistors 12*c* and 12*d* in a generally known manner to the servomotor 4, this enabling the latter to be driven in counter-clockwise or clockwise direction in dependence upon the polarity of the signal produced.

The supply voltages for the servomotor 4 to be driven in counter-clockwise and clockwise direction are symbolically indicated by the two energy sources 20 and 21. In dependence upon the voltage as produced by the Hall generator 6, and the comparison voltage provided by the potentiometer 19, the P/D-controller 12*a* produces a signal which, after having been amplified, is effective to drive the servomotor 4 in respective manner either in counter-clockwise or clockwise direction, this making the printing head 1 adjust itself in relation to the record medium 2 in such a manner that a constant distance between the printing needles 13 of the printing head 1 and the record medium 2 is reached and held, respectively. The dimension of the said distance which is to be maintained can be determined by the adjustment of the potentiometer 19.

Figure 5:
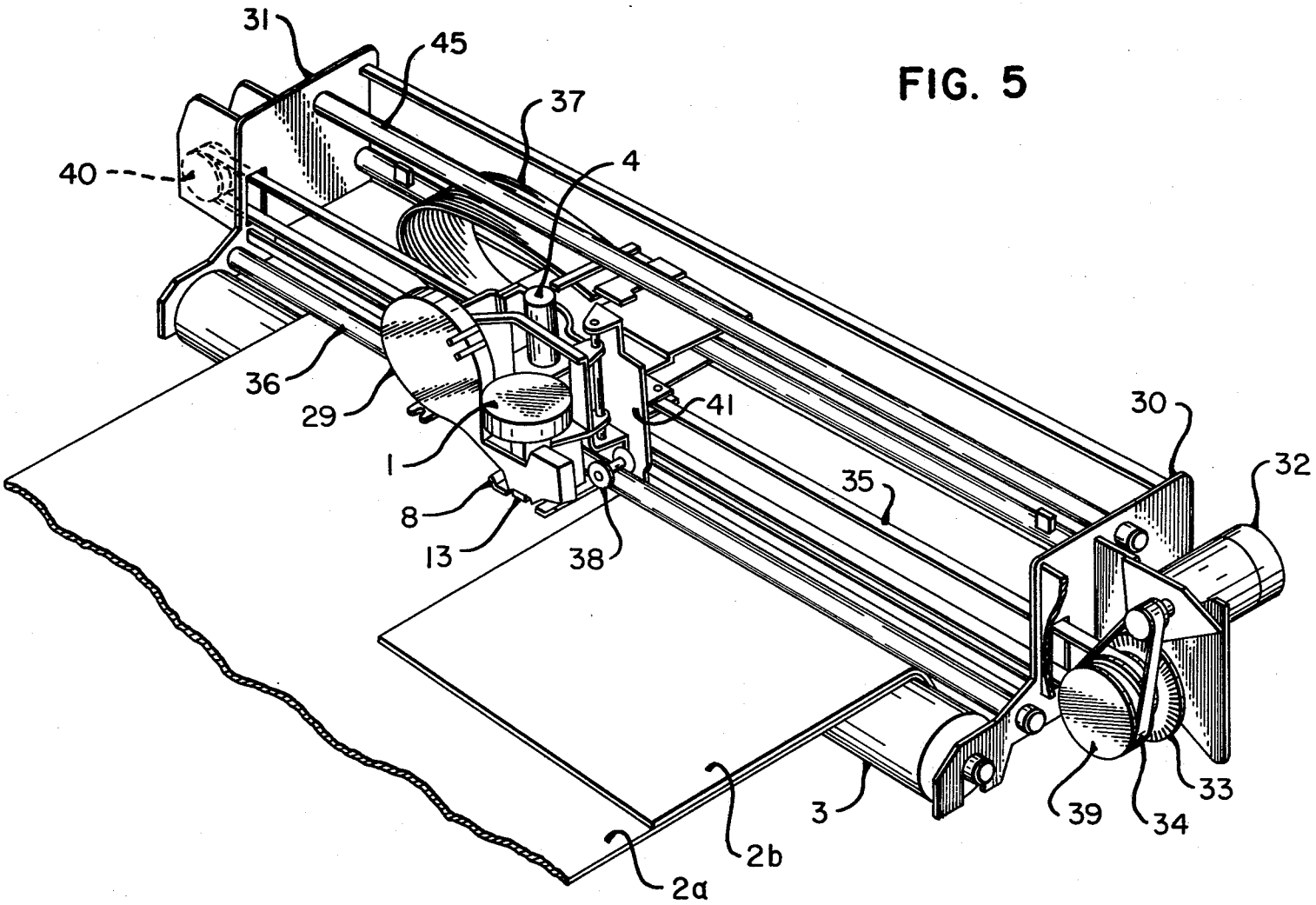
FIG. 5 is a perspective view of a modified form of the present invention.

Shown in FIG. 5 is another embodiment of the present invention illustrating one way in which the arrangement as per the present invention can be used for the distance control in a serial-type needle printer. In FIG. 5 the printing head 1 is arranged on a carrier 41 which is movable transversely to the drawing-in direction of record media 2*a* and 2*b*. Through an appropriate recess provided in the distance feeler 8 which is resting lightly upon the record media 2*a*, 2*b*, the needles 13 of the printing head 1 can be passed through in desired series. Between the needles 13 and the record media 2*a*, 2*b*, in a known manner, is guided the ink-ribbon of an ink-ribbon means 29. The carrier 41 slides by means of rolls 38 on a fastening rod 36 which together with the rod 45 is fixed in two side frame parts 30 and 31. The energy supply and control of the printing head as well as of the automatic distance control system is provided via a flexible conducting tape 37 in generally known manner.

Both the magnet which is connected to the distance feeler 8 and the Hall generator as used are not to be seen from FIG. 5 since they are located behind the printing head 1. The distance of the printing head 1 is controlled by the servomotor 4 in the previously described manner in dependence upon the thickness of the record media 2*a* and 2*b*, respectively. The carrier 41 is transported transversely to the drawing-in direction of the two record media, i.e. in line direction, by means of a belt 35 which is guided over a deflection roll 40. The belt 35 is driven via a motor 32 which, via a driving belt 34, is effective to drive a roll 39. By the aid of a synchronizing disc 33 the positioning of the carrier 41 and the printing head 1, respectively, can be accomplished.

The two record media 2*a* and 2*b* of different thicknesses can be drawn-in by means of a pulling-in mechanism, not shown, the latter being for instance provided in the form of grippers arranged transversely to the platen 3. The record medium 2*a* may be a ledger card and the record medium 2*b* may be a savings book. Through the distance feeler 8 lightly resting upon the record media, the thickness of the latter is ascertained. In dependence upon said thickness, the control of the distance between the printing needles 13 and the surface of the respective record medium opposite thereto to a desired dimension, for instance to 0.3 mm, is accomplished through the Hall generator 6, the circuit of FIG. 4, and the servomotor 4, in the manner previously described.

Through the exact control of the printing head distance in accordance with the present invention it is ensured that without the danger of the record medium's being damaged or displaced, an exact and clean print can be obtained. This is possible since the printing needles 13 always strike at a constant impact and after a constant track against the record medium.

Since the printing speed of matrix printing heads is highly dependent on the track of the needles, there is moreover possible a simple adjustment of the optimal track of the printing needles, i.e. of the maximal printing speed.

What is claimed is:

1. A printing device for printing on record media which may be of different and varying thicknesses, said record media being introduced to the printing device in a given direction, comprising:

a carriage;

a carrier operatively connected to the carriage;

a frame mounted on said carrier;

a printer mounted on said frame, said printer and said carriage being capable of relative movement therebetween in a direction transverse to the direction of introduction of the record media to the printing device;

positioning means operatively connected to the frame and the carrier and including a motor capable of continuously positively positioning the frame with respect to the carrier in either of two directions so that the printer is located a predetermined distance from the record media for proper printing thereon;

circuit means including a Hall effect transducer fixed to the frame, a comparator for comparing a reference voltage with the voltage generated by the Hall effect transducer and switching means controlled by the comparator for controlling said positioning means; and sensing means pivotally mounted between its ends on said frame and including a feeler at one end, said sensing means being biased to engage the record media and to be continuously responsive to variations in the thickness thereof, said sensing means also including magnetic means at its other end for coacting with the Hall effect transducer for causing said circuit means continuously to control the positioning means to alter the position of the printer in accordance with movement of the sensing means to maintain continuously said printer a predetermined distance from the record media regardless of variations in the thickness of said media.

2. A printing device for printing on record media which may be of different and varying thicknesses, said record media being introduced to the printing device in a given direction, comprising:

a carriage;

a frame operatively connected to the carriage;

a printer mounted on said frame, said printer and said carriage being capable of relative movement therebetween in a direction transverse to the direction of introduction of the record media to the printing device;

positioning means operatively connected to the frame and including a motor capable of continuously positioning the frame so that the printer is located a predetermined distance from the record media for proper printing thereon;

circuit means including a Hall effect transducer, a comparator for comparing a reference voltage with the voltage generated by the Hall effect transducer, first switching means controlled by the comparator for controlling said positioning means, and second switching means for selectively applying a predetermined voltage level to the comparator in place of the voltage generated by the Hall effect transducer to cause the motor to move the frame in a direction away from the record media; and sensing means pivotally mounted between its ends on said frame and including a feeler at one end, said sensing means being biased to engage the record media and to be continuously responsive to variations in the thickness thereof, said sensing means also including magnetic means at its other end for coacting with the Hall effect transducer for causing said circuit means to control the positioning means to alter the position of the printer in accordance with movement of the sensing means to maintain continuously said printer a predetermined distance from the record media regardless of variations in the thickness of said media.

* * * * *